United States Patent [19]

Werner et al.

[11] 4,454,495

[45] Jun. 12, 1984

[54] LAYERED ULTRA-THIN COHERENT STRUCTURES USED AS ELECTRICAL RESISTORS HAVING LOW TEMPERATURE COEFFICIENT OF RESISTIVITY

[75] Inventors: Thomas R. Werner, Argonne, Ill.; Charles M. Falco, Tucson, Ariz.; Ivan K. Schuller, Woodridge, Ill.

[73] Assignee: The United States of America as represented by the United States Department of Energy, Washington, D.C.

[21] Appl. No.: 413,637

[22] Filed: Aug. 31, 1982

[51] Int. Cl.[3] ..... H01C 10/00

[52] U.S. Cl. ..... 338/195; 338/9; 338/314; 338/320

[58] Field of Search ..... 338/195, 7, 9, 10, 320, 338/314; 29/620, 610; 204/192 F, 192 C, 192 SP

[56] References Cited

U.S. PATENT DOCUMENTS 3,896,284 7/1975 Holmes ..... 338/195 X
4,345,236 8/1982 Eichelberger et al. ..... 338/314 X

FOREIGN PATENT DOCUMENTS 47-3409 1/1972 Japan ..... 338/9
50-25149 8/1975 Japan ..... 338/9
17980 of 1913 United Kingdom ..... 338/9

OTHER PUBLICATIONS

Eckertova, "Physics of Thin Films," Plenum Press, New York, 1977, pp. 224–229.

Maissel et al., *Handbook of Thin Film Technology*, "Thin Film Resistors," McGraw-Hill, New York, Chapter 18, pp. 18-3–18-41, 1970.

I. K. Schuller et al., "Superconductivity and Magnetism in Metallic Superlattices," Argonne National Laboratory Publication, 1981, pp. 1–20.

*Primary Examiner*—C. L. Albritton

*Attorney, Agent, or Firm*—Walter R. Rees; James W. Weinberger

[57] ABSTRACT

A thin film resistor having a controlled temperature coefficient of resistance (TCR) ranging from negative to positive degrees kelvin and having relatively high resistivity. The resistor is a multilayer superlattice crystal containing a plurality of alternating, ultra-thin layers of two different metals. TCR is varied by controlling the thickness of the individual layers. The resistor can be readily prepared by methods compatible with thin film circuitry manufacturing techniques.

8 Claims, 3 Drawing Figures

LAYERED ULTRA-THIN COHERENT STRUCTURES USED AS ELECTRICAL RESISTORS HAVING LOW TEMPERATURE COEFFICIENT OF RESISTIVITY

CONTRACTUAL ORIGIN OF THE INVENTION

The United States Government has rights in this invention pursuant to Contract No. W-31-109-ENG-38 between the U.S. Department of Energy and Argonne National Laboratory.

BACKGROUND OF THE INVENTION

This invention relates to thin film resistors. More specifically, this invention relates to thin film resistors which have a controlled TCR ranging from minus to positive degrees kelvin.

Useful electronic circuits contain a combination of both passive components, which only transmit energy, consuming a part of it and active components, such as transistors. It is important that the passive components are compatible with the active components both in fabrication and in circuit performance. This is especially important when preparing miniaturized circuits by thin-film techniques.

Resistors for use in such circuits must have a well characterized resistivity and temperature coefficient of resistance, hereinafter referred to as TCR. The TCR is a measure of the change in resistance with respect to the change in operating temperature of the resistor and is commonly expressed in units of ppm/K. A resistor with a positive, negative or zero TCR may be required depending on the type of circuit and its particular applications. Moreover, the bulk and sheet resistivities of these components should be as independent of the TCR as possible. Thus, it is preferable that methods of fabricating thin-film resistors in addition to the requirements mentioned above, be able to produce resistors of preselected resistivity and TCR.

Present processes for preparing thin-film resistors includes the plating of nickel-chromium alloys on a substrate by thermal-evaporation of nickel-chromium compounds in a vacuum, or by the ion-bombardment of a nickel-chromium target. However, if evaporation resistors are made from metals with resistivity on the order of $10^{-4}$ Ωcm, high resistance values can only be achieved by the formation of very thin films which are often discontinuous. Tantalum, titanium and niobum have also been used, being deposited by cathode sputtering so as to possess resistance lower than the one required. For high values of resistance, use is also made cermet films which are mixtures of metals and dielectrics. With cermet films, resistivity increases with the dielectric content and may vary over a wide range. These films are usually deposited on ground porcelain tubes or plates.

Of the most commonly used thin film resistor materials, the alloy Ni(80)Cu(20) has a resistivity of about 110 μΩcm and a TCR of 85 while Ni(76), Cu(20), Al(2), Fe(2) has a resistivity of 133 μΩcm and a TCR of about 5.

However, all of these thin film resistors are prepared from alloys and it is difficult to prepare alloys having a precise composition, so as to combine resistivity and TCR, by any of the thin film deposition techniques. Thus, the reproducibility and hence the ability to control the TCR and resistivity is difficult, if not impossible to achieve.

U.S. patent application Ser. No. 202,083 filed Oct. 30, 1980 and assigned to the common assignee, (incorporated herein by reference) described a new material which is a coherent multilayer crystal containing at least two elements which are metals, each layer consisting of a single crystalline element at least 2 Å in thickness, the elements being materials which will grow epitaxially on each other without forming intermetallic compounds.

SUMMARY OF THE INVENTION

It has been found that by a proper choice of metals and layer thicknesses, it is possible to prepare a coherent, multilayer crystal which has a predetermined TCR, a medium to high resistivity and which is suitable for use as an electrical resistor. Furthermore, the coherent multilayer crystals are easily reproducible by established thin film technology.

The thin film electrical resistor of the invention has a predetermined temperature coefficient of resistance ranging from negative to positive ppm/K and comprises a coherent, multilayer crystal of alternating layers of two metallic elements, the two elements being from the group of copper and niobum, nickel and tungsten, and nickel and molybdenum, each layer being about the same thickness and consisting of a single crystalline metal element at least 2 Å in thickness to form a resistor having a negative TCR, the TCR lncreasing to 0 and becoming positive as the individual layer thickness is increased.

The single crystal multilayer resistors of the invention have a resistivity ranging from about 100 to 160 μΩcm depending upon the combination of materials and layer thickness.

The resistors of the invention are easily reproducible and are readily prepared by known thin film technology such as by ion beam sputtering under vacuum conditions onto a heated substrate.

It is therefore the object of the invention to provide a thin film resistor having medium to high resistivity and having a TCR controllable from negative to positive.

It is another object of the invention to produce a thin film resistor having a medium to high resistivity and having a TCR controllable from negative to positive which can be readily and easily reproduced.

Finally, it is the object of the invention to provide a thin film resistor having a medium to high resistivity, and a predetermined TCR, which is compatible with other thin film components, and which can be prepared using readily available thin film technology.

DETAILED DESCRIPTION OF THE PREFERRED EMBODIMENT

Figure 1:
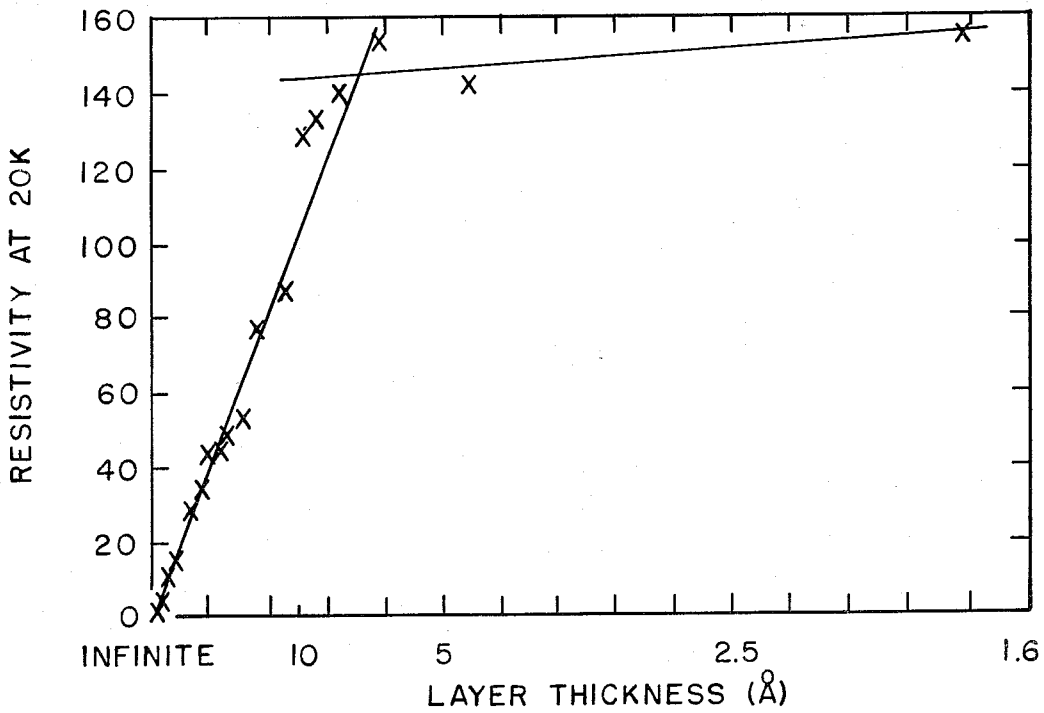
FIG. 1 is a curve showing the relationship between layer thickness in angstroms and resistivity in μΩcm in a niobium-copper resistor at 20K.

These and other objects of the invention may be met by a coherent, multilayer crystal having a plurality of alternating layers of niobum and copper of about the same thickness, each layer consisting of a single crystalline element at least 2 Å in thickness to form a resistor having a TCR of about −15 ppm/K, the TCR increasing to 0 and becoming positive as the individual layer thickness is increased.

The coherent, multilayer crystal resistors are preferably prepared of alternating layers of copper and niobium. Other combinations of metals which will provide suitable resistors include nickel and tungsten and nickel and molybdenum.

Individual layer thickness of the metals in the crystal resistor may vary from 2 Å to about 50 Å. For a niobium-copper resistor, the TCR will vary from about −15 ppm/K at 2 Å to about 0 ppm/K at about 10 Å, becoming positive above about 10.5 Å to about +25 ppm/K at 50 Å in thickness. The layer thickness at which the TCR will be about 0 may vary slightly between the various combination of metals, but it will generally be between 7 and 14 Å. The TCR once determined, is expected to remain constant at temperatures up to about 500° K., or until such temperature as diffusion between the metal layers begins to take place and the resistor begins to lose its coherent crystalline structure.

Resistivity of the crystal resistor may vary from about 100 to about 160 μΩcm, depending on the metals which make up the crystal and the layer thickness. Thus a niobium-copper crystal having layers about 2 Å in thickness has a resistivity of about 150 μΩcm, at about 10 Å thickness, the resistivity is about 120 μΩcm, and at about 50 Å thickness the resistivity at about 90 μΩcm.

The crystals should be at least 300 Å in thickness in order to provide adequate current carrying capacity and because in certain cases about 100 Å of the surface consists of an oxide of different electrical characteristics.

The resistors are preferably prepared by ion beam sputtering. By this method, an appropriate substrate, such as saphire, masked as required, is placed into a vacuum chamber containing a sputtering gun for forming a beam of atoms for each of the elements in the crystal, the gun being capable of sputtering at a rate between 10 and 200 Å per second. The substrate is positioned about 15" for the source of the beams. The vessel is sealed and the ambient gas pumped from the vessel before an argon sputtering gas pressure of about $10\times6^{-3}$ ion is established. The substrate is heated to 150° to 450° C. and a beam of sputtered atoms is established for each sputtering gun. The sputtering gas pressure and the distance from the source of the beams of atoms to the substrate must be sufficient to reduce the temperature of the atoms in the beam as they reach the substrate to about the same temperature as the substrate, so that as the atom contact the substrate they have sufficient energy to form a crystalline structure but not enough energy to displace or eject atoms in the crystal or in layers already formed. The multilayer crystal is formed by alternately passing each beam of sputtered atoms over the substrate to deposite a plurality of alternate coherent layers of the two crystalline materials on the substrate to form the coherent multilayer crystal resistor. The individual layer thickness is controlled by the time of deposition.

The following Examples are given to illustrate the invention and are not to be taken as limiting the scope of the invention which is defined by the appended claims.

EXAMPLE I

Coherent, multilayer niobum-copper crystals were prepared using the method previously described. Single crystal (90° orientation) sapphire substrates were held on a rotating platform which moved them alternatingly between the two beams of sputtered Nb and Cu particles. In this manner, samples of individual layer thickness in the range 3.6 Å to 5000 Å with a total film thickness of about 1 μm were prepared. Resistivity measurements in a wide temperature range (10 K.–400 K.) were made on each of the samples. FIG. 1 shows a graph of the resisivity measurements versus layer thickness for the samples at 20 K. It can be seen that above 10 Å layer thickness the electrical resistivity is inversely proportional to the layer thickness. Below 10 Å the resistivity approaches saturation close to the Ioffe-Regel limit of 150 μΩcm.

EXAMPLE II

Figure 2:
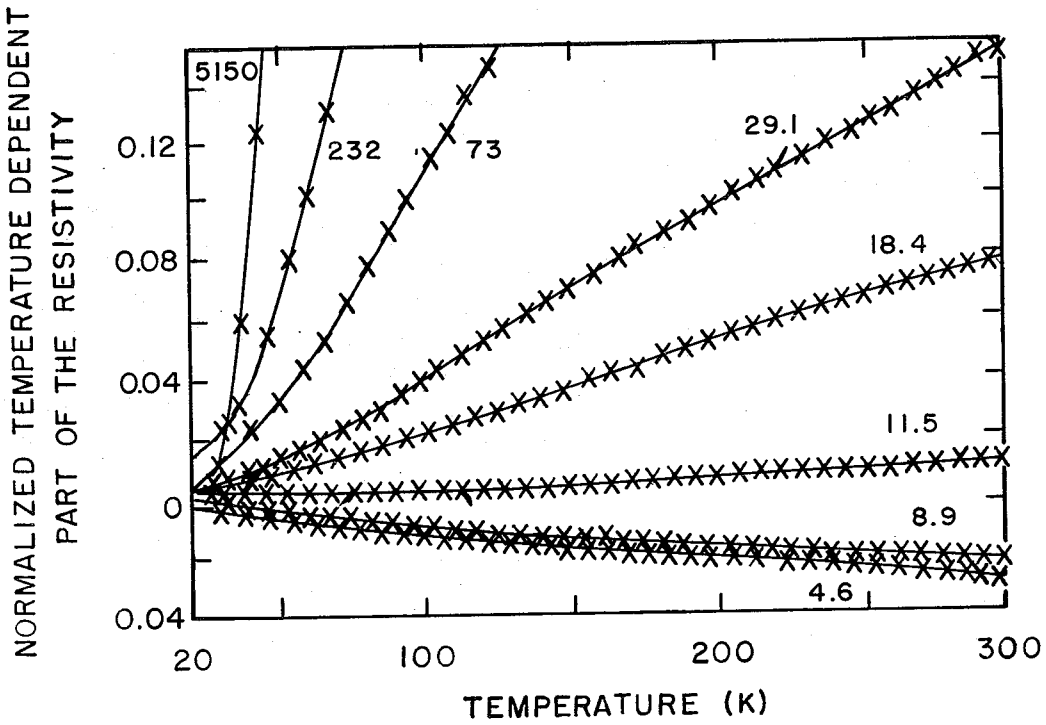
FIG. 2 is a series of curves of niobum-copper crystals of different layer thickness showing the relationship between temperature and the normalized temperature dependent part of the resistivity.

The niobium-copper crystal samples from Example I were cooled to 20 K. and the resistivity measured. Additional resistivity measurements were made as the samples were warmed to room temperature (300 K.). The normalized temperature dependent part of the resistivity $[(\rho(T)-\rho(20)/\rho(20)]$ is plotted against the temperature for the various layer thicknesses in FIG. 2. Note the systematic way in which the resistivity is a function of the layer thickness.

EXAMPLE III

Figure 3:
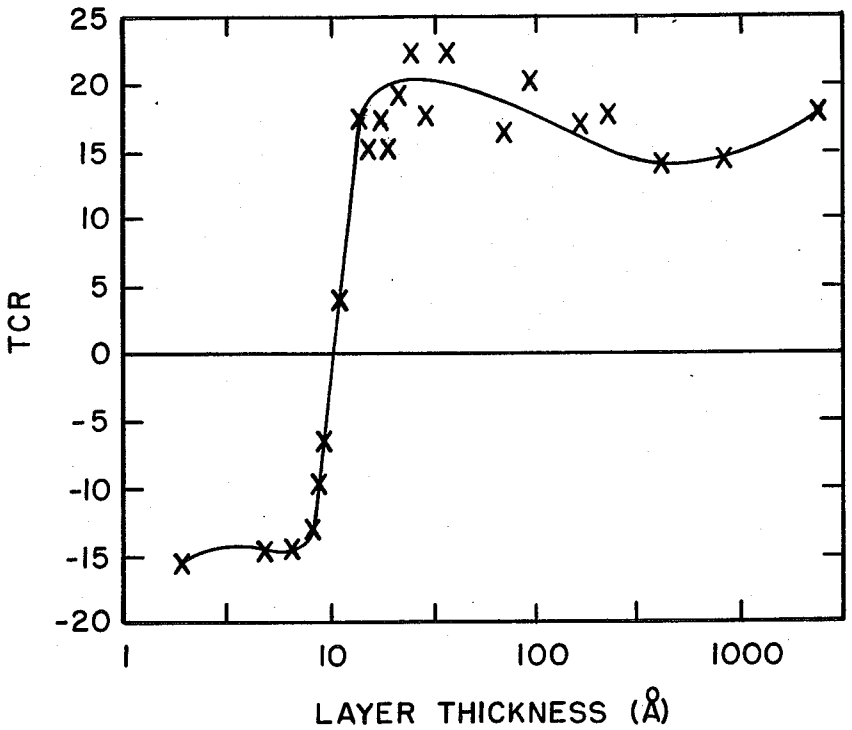
FIG. 3 is a curve showing the relationship between layer thickness in angstroms and TCR in niobum-copper resistors.

Resistivity measurements were then made of the various samples while they were heated from about 20 to 400 K. in order to determine the TCR. The results are given in FIG. 3. Note that the TCR is about 0 ppm/K at a layer thickness of 10 Å within this temperature range. It should be noted that the change from positive to negative TCR occurs for a mean-free path which is changed by only 2–3 atomic spacings (about 5–6 Å).

EXAMPLE IV

Coherent, multilayer nickel-molybdenum crystals were prepared on a mica substrate using the method desribed in Example I. At an individual layer thickness between 7.6 and 8.3 Å, the TCR was found to be about 8 ppm/K, and the resistivity was 160 μΩcm.

As can be seen from the preceeding discussion and Examples, the coherent, multilayer crystal of the invention provides an effective thin-film electrical resistor having a controllable TCR and medium to high resistivity.

The embodiments of this invention in which an exclusive property or privilege is claimed are defined as follows:

1. A thin-film electrical resistor having a predetermined coefficient of resistance ranging from negative to positive ppm/K comprising: a coherent, multilayer crystal consisting of alternating layers of two metallic elements, the two elements being selected from the group of copper and niobium, nickel and tungsten and nickel and molybdenum, the layers being of about the same thickness, each layer consisting of a single crystalline element at least 2 Å in thickness to form a resistor having a negative temperature coefficient to resistance increasing to 0 and becoming positive as the layer thickness is increased.

2. The thin-film resistor of claim 1 wherein the crystal is at least 300 Å in thickness.

3. The thin-film resistor of claim 2 wherein individual layer thickness is from about 2 Å to about 50 Å in thickness.

4. The thin-film resistor of claim 3 wherein the resistor is composed of niobium and copper.

5. The thin-film resistor of claim 4 wherein the layer thickness is about 2 Å to 10 Å and the TCR is negative.

6. The thin-film resistor of claims 5 wherein the layer thickness is from about 10 to 11 Å in thickness, and the TCR is about 0 ppm/K.

7. The thin-film resistor of claim 6 wherein the layer thickness is greater than about 11 Å and the TCR is positive.

8. The thin-film resistor of claim 3 wherein the resistor is composed of nickel and molybdenum.

* * * * *